US005816147A

United States Patent [19]

Manduley et al.

[11] Patent Number: 5,816,147

[45] Date of Patent: Oct. 6, 1998

[54] LOSS OF FUNDS PREVENTION FOR POSTAGE METERS THAT USE TRANSFER PRINTING AND INK JET PRINTING

[75] Inventors: Flavio M. Manduley, Woodbury; Maria Paz Parkos, Southbury, both of Conn.

[73] Assignee: Pitney Bowes Inc., Stamford, Conn.

[21] Appl. No.: 738,490

[22] Filed: Oct. 28, 1996

[51] Int. Cl.[6] ..... B41L 47/46

[52] U.S. Cl. ..... 101/91; 400/74

[58] Field of Search ..... 101/91, 92, 93, 101/45; 364/469.02; 400/74

[56] References Cited

U.S. PATENT DOCUMENTS

| | | | |
|---|---|---|---|
| 4,796,527 | 1/1989 | Erwin | 101/70 |
| 4,905,980 | 3/1990 | Nobile et al. | 101/91 |
| 5,020,429 | 6/1991 | Riley et al. | 101/93 |
| 5,075,852 | 12/1991 | Salazar et al. | 364/464.02 |
| 5,251,554 | 10/1993 | Eckert, Jr. et al. | 101/91 |
| 5,433,537 | 7/1995 | Gallagher et al. | 400/74 |
| 5,640,903 | 6/1997 | Salomom | 101/91 |
| 5,657,689 | 8/1997 | Lee | 101/91 |

*Primary Examiner*—Christopher A. Bennett
*Attorney, Agent, or Firm*—Ronald Reichman; Melvin J. Scolnick

[57] ABSTRACT

This invention prevents the accounting unit of a postage meter from deducting funds when a mailpiece has been removed. The foregoing is achieved by giving the postage meter the intelligence to stop printing the postal indicia and deducting the value of the postal indicia just before the indicia is printed. This would eliminate the loss of funds due to problems between trip command and actual indicia printing. The apparatus of this invention utilizes a sensor to detect the presence of a mailpiece at a printing position and a detector to determine the location of the indicia printing plate or the time that an ink jet printer is going to print so that the system will be able to prevent the printing of a postal indicia and deducting the value of the postal indicia just before the indicia is printed.

14 Claims, 5 Drawing Sheets

LOSS OF FUNDS PREVENTION FOR POSTAGE METERS THAT USE TRANSFER PRINTING AND INK JET PRINTING

FIELD OF THE INVENTION

The invention relates generally to the field of imprinting devices and more particularly to a postal meter imprinting device.

BACKGROUND OF THE INVENTION

Since the issuance of U.S. Pat. No. 1,530,852 to Arthur H. Pitney, Mar. 24, 1925, the postage meter has had a steady evolution. Each meter had a printer included therein on a one-to-one basis, i.e. one metering device and one printing device incorporated into a unit. In postage meters, the need for security is absolute. Such security is applied to postage meters both to the printing portion of the meter and the accounting portion. The reason for the need for absolute security is because a postage meter is printing value, and unless security measures are taken, one would be able to print unauthorized postage, i.e. postage for which no payment is made, thereby defrauding the post office.

Prior art postage meters included a accounting portion, a postal indicia printing portion and a control portion that was coupled to the accounting portion and the printing portion. Some postage meters utilized transfer printing techniques to print the postal indicia on a mailpiece or label. Transfer printing or offset printing was accomplished by affixing a plate bearing a postal indicia to a portion of a printing drum or cylinder, that received ink from an inking roller and transferring the inked postal indicia or indicia imprint to a mailpiece or label. The prior art also utilized a print head instead of an inking roller to supply an inked postal indicia to the printing drum or cylinder. When the printing drum commenced rotating the value of the postal indicia was subtracted from the accounting portion of the postal meter and the postal indicia was imprinted on the mailpiece when the indicia portion of the printing roller came in contact with the mailpiece. The problem with preventing fraudulent postal indicia impression taking involves exposure of the printing drum. The printing drum may be pressed against a mailpiece or label to obtain unauthorized postage.

Typically, a photocell was placed before the printing drum and the photocell would detect the presence of a mailpiece, which would cause the printing drum to start rotating. Then the value of the postal indicia would be subtracted from the accounting portion of the postal meter. Thus, if the mailpiece was jiggled or pulled away from the photocell, the accounting portion of the postal meter would deduct the value of the postal indicia, even though the postal indicia was not printed on the mailpiece.

SUMMARY OF THE INVENTION

This invention overcomes the disadvantages of the prior art by preventing the accounting unit of a postage meter from deducting funds when a mailpiece has been removed. The foregoing is achieved by giving the postage meter the intelligence to stop printing the postal indicia and deducting the value of the postal indicia just before the indicia is printed. This would eliminate the loss of funds due to problems between trip command and actual indicia printing. The apparatus of this invention utilizes a sensor to detect the presence of a mailpiece at a printing position and a detector to determine the location of the indicia printing plate so that the system will be able to prevent the printing of a postal indicia and deducting the value of the postal indicia just before the indicia is printed. In an alternate embodiment of this invention a sensor is used to detect the presence of a mailpiece at a printing position and a microprocessor to control an ink jet head so that the system will be able to prevent the printing of a postal indicia and deducting the value of the postal indicia just before the indicia is printed.

DETAILED DESCRIPTION OF THE PREFERRED EMBODIMENT

Figure 1:
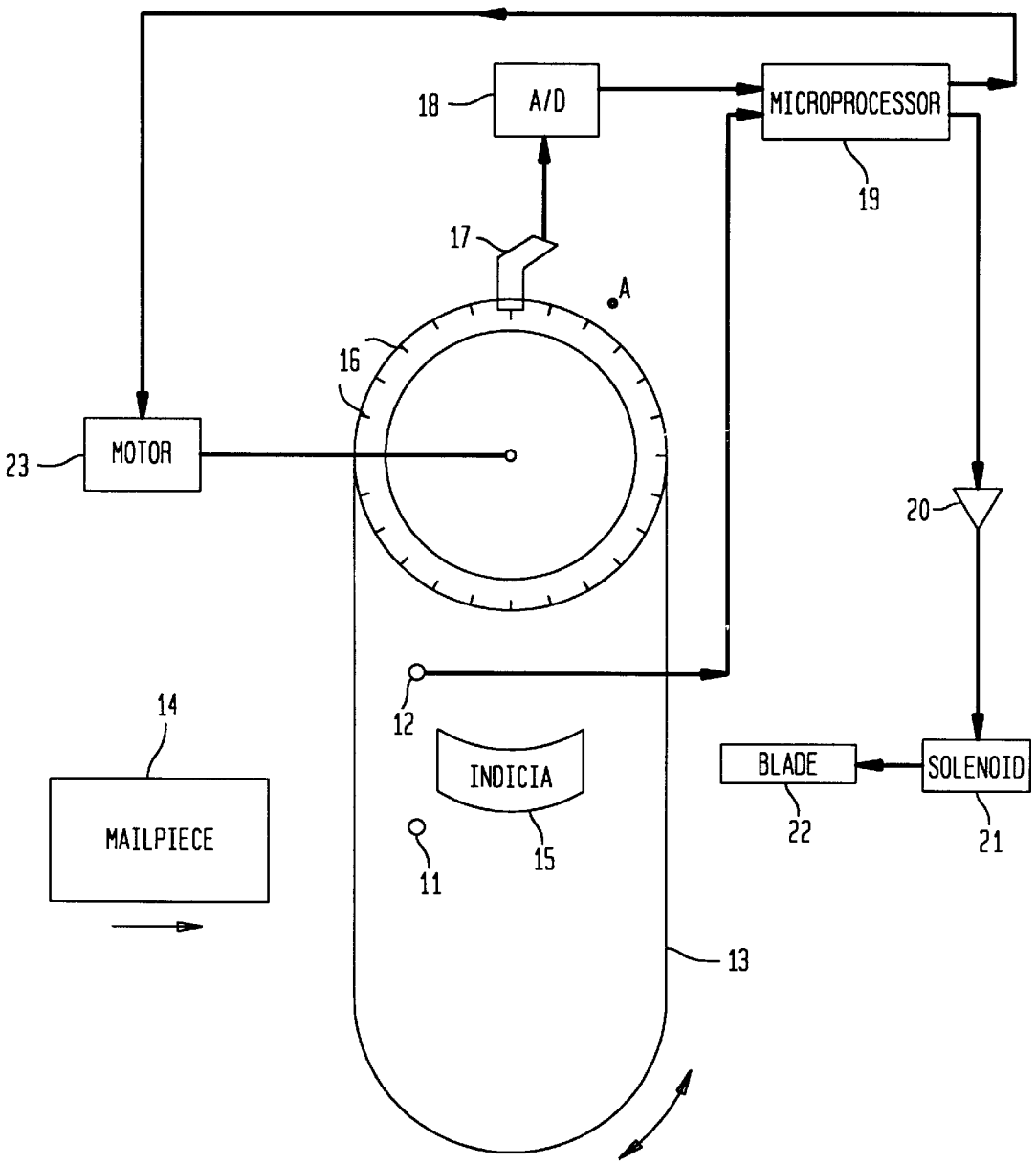
FIG. 1 is a drawing of the apparatus of this invention.

Referring now to the drawings in detail, and more particularly to FIG. 1, the reference character 11 represents one side of an optical sensor that shines a light that is received by side 12 of the optical sensor. Sides 11 and 12 are affixed to printing drum 13 in a manner that the presence of mailpiece 14 at a specific location would prevent the light from side 11 from reaching side 12. A postal indicia printing plate 15 is affixed to the side of printing drum 13 and a plurality of equally spaced markings 16 are affixed to the top of drum 13. Markings 16 may be replaced with variable resistances or other analog outputs known in the art. Plate 15 may receive ink by any manner known in the art, i.e. inking roller, ink head, etc. Photodetector 17 is positioned above drum 13 in a manner that photodetector 17 will sense markings 16 and transmit analog position signals to analog to digital converter 18. It will be obvious to one skilled in the art that markings 16 may be non-uniformly placed on a variable resistor that is detected by photodetector 17. Analog to digital converter 18 will convert its analog input signals into digital signals that will be transmitted to microprocessor 19. Side 12 of the optical sensor is also coupled to one of the inputs of microprocessor 19. Microprocessor 19 will then be able to determine the distance that drum 13 rotated from home position A and how far indicia 15 is from home position A. Microprocessor 19 is also coupled to motor 23 and motor 23 is coupled to drum 13. Hence, microprocessor 19 will control the rotation of drum 13. The manner in which a microprocessor and motor control the rotation of a printing drum is well known in the art.

Thus, end 12 of the optical sensor will inform microprocessor 19 when indicia 15 is about to be impressed on mailpiece 14. If, after end 12 notifies microprocessor 19 that mailpiece 14 is present and before indicia printing surface 15 is impressed on mailpiece 14, end 11 receives a light signal from side 11, microprocessor 19 will known that indicia 15 should not be impressed on mailpiece 14. The output of microprocessor 19 is coupled to the input of driver 20 and the output of driver 20 is coupled to solenoid 21. When microprocessor 19 knows that the printing of the indicia should be stopped, microprocessor 19 motor 23 to rotate drum 13 back to home position A. drum 13 will rotate in the opposite direction that it was previously rotating. Microprocessor 19 also causes driver 20 to activate solenoid 21. Solenoid 21 will cause wiper blade 22 to remove the ink that was placed on indicia printing plate 15.

The embodiment described in FIG. 1 is likely to be used in situations in which mailpiece 14 is manually inserted.

Figure 2:
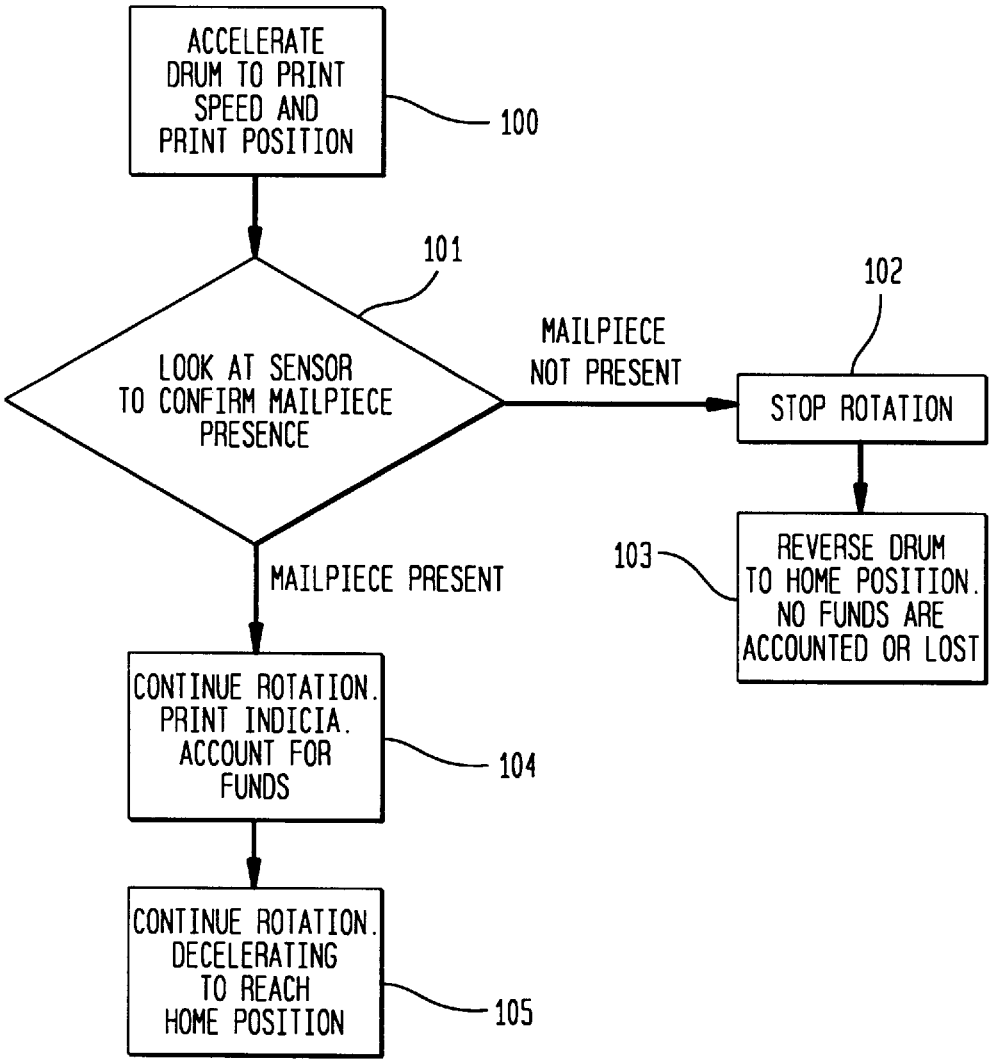
FIG. 2 is a drawing of a flow chart of a program contained in microprocessor 19 of FIG. 1 to prevent the loss of funds.

FIG. 2 is a drawing of a flow chart of a program contained in microprocessor 19 of FIG. 1 to prevent the loss of funds. The program begins in block 100 and waits to receive a command to accelerate drum 13 to print speed and print position. Drum 13 begins moving from home position A to the position that indicia printing plate 15 will impress an indicia on mailpiece 14. Then, the program proceeds to decision block 101 to look at the optical sensor to confirm the presence of mailpiece 14 at the printing position. If, block 101 determines that mailpiece 14 is not present at the printing position, then the program proceeds to block 102 to stop the rotation of drum 13. Then the program proceeds to block 103 to reverse the rotation of drum 13 and return drum 13 to home position A. No funds for the printing of a postal indicia will be accounted for or lost. If, block 101 determines that that mailpiece 14 is present at the printing position, then the program proceeds to block 104 to continue the rotation of drum 13 and to print a postal indicia on mailpiece 14. The accounting unit of the postal meter (not shown) will account for the value of the postal indicia printed. Then the program goes to block 105 to continue the rotation of drum 13 to home position A.

Figure 3:
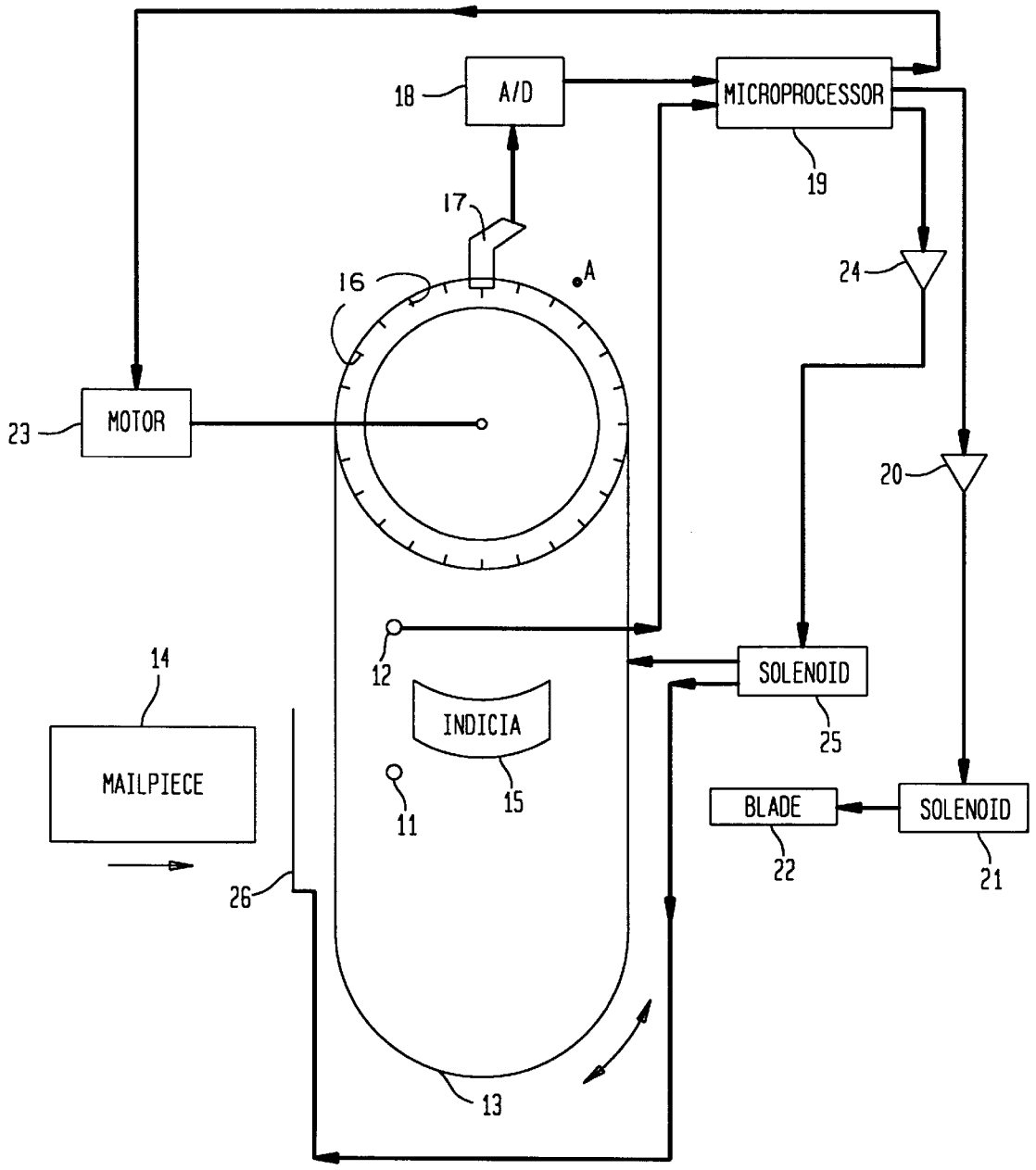
FIG. 3 is a drawing of an alternate embodiment of the apparatus of this invention.

FIG. 3 is a drawing of an alternate embodiment of the apparatus of this invention and is likely to be used in situations in which mailpiece 14 is automatically inserted. Sides 11 and 12 of the optical sensor are affixed to printing drum 13 in a manner that the presence of mailpiece 14 at a specific location would prevent the light from side 11 from reaching side 12. A postal indicia printing plate 15 is affixed to the side of printing drum 13 and a plurality of equally spaced markings 16 are affixed to the top of drum 13. Plate 15 may receive ink by any manner known in the art, i.e. inking roller, ink head, etc. Photodetector 17 is positioned above drum 13 in a manner that photodetector 17 will sense markings 16 and transmit analog position signals to analog to digital converter 18. Analog to digital converter 18 will convert its analog input signals into digital signals that will be transmitted to microprocessor 19. Side 12 of the optical sensor is also coupled to one of the inputs of microprocessor 19. Microprocessor 19 will then be able to determine the distance that drum 13 rotated from home position A and how far indicia 15 is from home position A. Microprocessor 19 is also coupled to motor 23 and motor 23 is coupled to drum 13. Hence, microprocessor 19 will control the rotation of drum 13. The manner in which a microprocessor and motor control the rotation of a printing drum is well known in the art.

Thus, end 12 of the optical sensor will inform microprocessor 19 when indicia 15 is about to be impressed on mailpiece 14. If, after end 12 notifies microprocessor 19 that mailpiece 14 is present and before indicia printing plate 15 is impressed on mailpiece 14, end 11 receives a light signal from side 11, microprocessor 19 will known that indicia printing plate 15 should not be impressed on mailpiece 14. The output of microprocessor 19 is coupled to driver 24 and driver 24 is coupled to solenoid 25. When microprocessor 19 knows that the printing of indicia 15 should be stopped, microprocessor 19 will drive driver 24 and driver 24 will activate solenoid 25. Solenoid 25 will pull drum 13 away from mailpiece 14. Solenoid 25 will also close gate 26 so that mailpiece 14 may not come in contact with indicia printing plate 15. The output of microprocessor 19 is coupled to the input of driver 20 and the output of driver 20 is coupled to solenoid 21. Microprocessor 19 will cause motor 23 to rotate drum 13 back towards home position A. Drum 13 will continue to rotate in the same direction that it was previously rotating. Microprocessor 19 will also causes driver 20 to activate solenoid 21 and solenoid 21 will cause wiper blade 22 to remove the ink that was placed on indicia printing plate 15. Microprocessor 19 will cause driver 24 to deactivate solenoid 25. Solenoid 25 will release drum 13 so that drum 13 will be at home position A. Solenoid 25 will also release gate 26 so that mailpiece 14 may be at a subsequent time be impressed with indicia printing plate 15.

Figure 4:
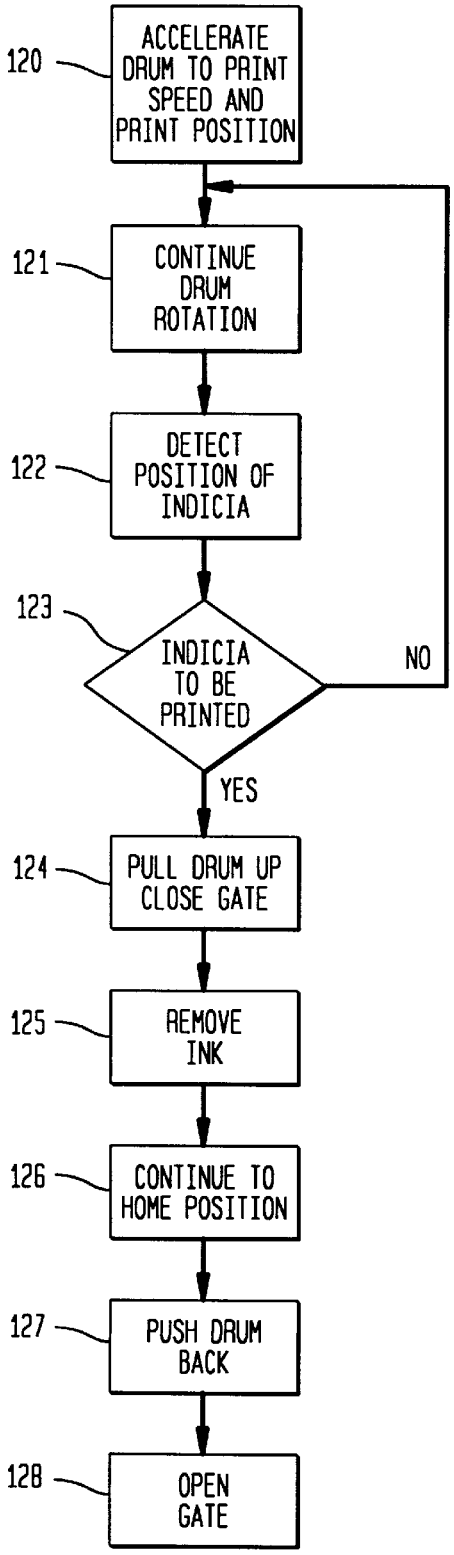
FIG. 4 is a drawing of a flow chart of the program contained in microprocessor 19 of FIG. 3 to prevent the loss of funds.

FIG. 4 is a drawing of a flow chart of a program contained in microprocessor 19 of FIG. 3 to prevent the loss of funds. The program begins in block 120 and waits to receive a command to accelerate drum 13 to print speed and print position. Drum 13 begins moving from home position A to the position that indicia printing plate 15 will impress an indicia on mailpiece 14. Then, the program process to block 121 to continue the rotation of drum 13. Now the program goes to block 122 to detect the position of indicia printing plate 15. Then the program proceeds to decision block 123 to determine whether or not an indicia is going to be printed on mailpiece 14. An indicia will be printed on mailpiece 14 if end 12 of the optical sensor detects the presence of mailpiece 14 and the indicia on printing plate 15 is impressed on mailpiece 14. If, block 123 determines that an indicia is not going to be printed on mailpiece 14, then and in that event the program proceeds back to block 121. If, block 123 determines that an indicia is going to be printed on mailpiece 14, then and in that event the program proceeds to block 124 to pull drum 13 away from mailpiece 14 and close gate 26. Now the program proceeds to block 125 to remove ink from indicia printing plate 15. Then the program proceeds to block 126 to continue the rotation of drum 13 to home position A. Then the program proceeds to block 127 to deactivate solenoid 25 and release drum 13 so that drum 13 will be at home position A. Now the program goes to block 128 to open gate 26. No funds for the printing of a postal indicia will be accounted for or lost.

Figure 5:
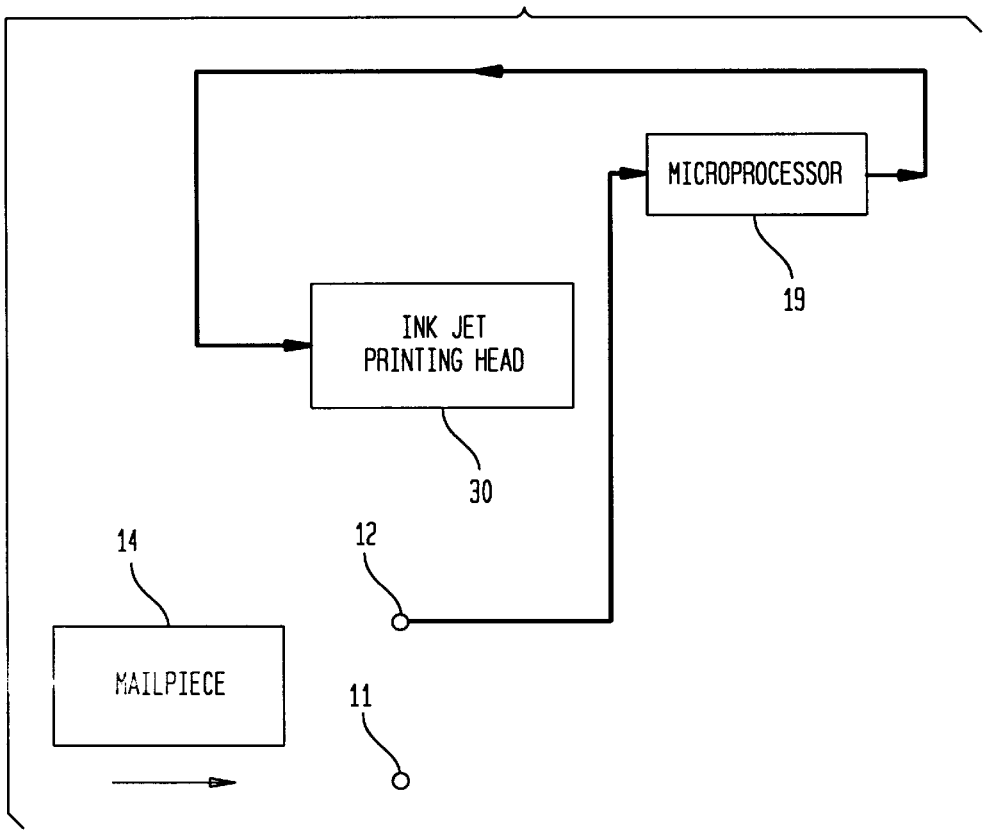
FIG. 5 is a drawing of an alternate embodiment of the apparatus of this invention.

FIG. 5 is a drawing of an alternate embodiment of the apparatus of this invention. One side of an optical sensor that shines a light that is received by side 12 of the optical sensor. Sides 11 and 12 are positioned in a manner that the presence of mailpiece 14 at a specific location would prevent the light from side 11 from reaching side 12. An ink jet printing head 30 that is capable of printing a postal indicia is positioned to print a postal indicia on mailpiece 14 when mailpiece 14 is in the proper position. Side 12 of the optical sensor is also coupled to one of the inputs of microprocessor 19. Microprocessor 19 will control the printing of ink jet printing head 30. The manner in which a microprocessor controls the printing of an ink jet printing head is well known in the art.

Thus, end 12 of the optical sensor will inform microprocessor 19 when an indicia is about to be printed on mailpiece 14 by ink jet printing head 30.. If, after end 12 notifies microprocessor 19 that mailpiece 14 is present and before the postal indicia is printed on mailpiece 14, end 11 receives a light signal from side 11, microprocessor 19 will known that the postal indicia should not be printed on mailpiece 14 by ink jet printing head 30. When microprocessor 19 knows that the printing of the indicia should be stopped, microprocessor 19 will turn ink jet printing head 30 off.

Figure 6:
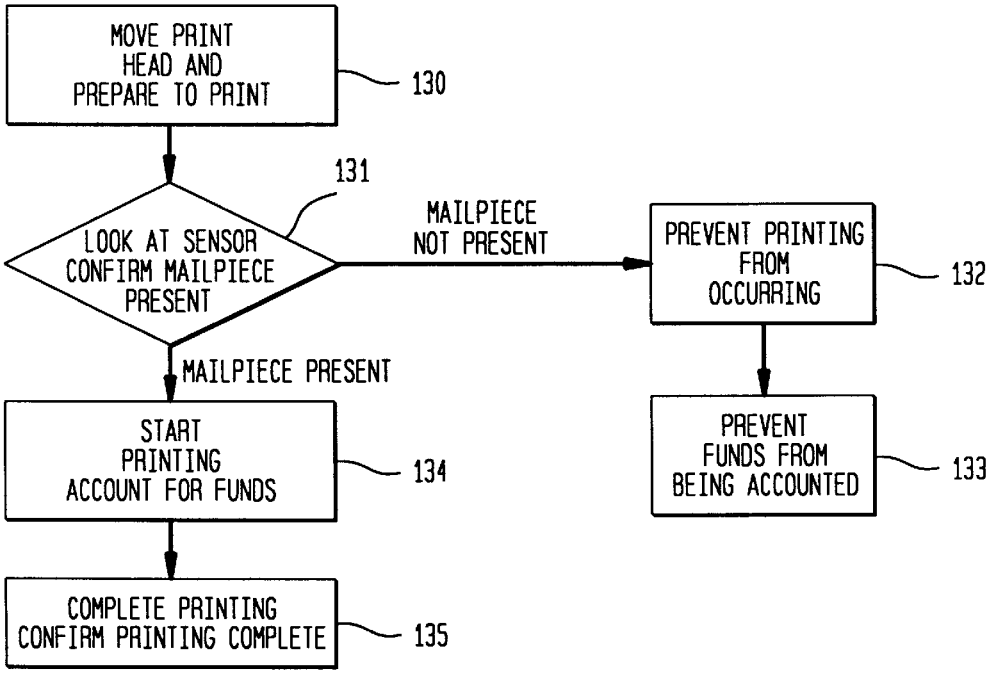
FIG. 6 is a drawing of a flow chart of the program contained in microprocessor 19 of FIG. 5 to prevent the loss of funds.

FIG. 6 is a drawing of a flow chart of a program contained in microprocessor 19 of FIG. 5 to prevent the loss of funds.

The program begins in block 130 and moves in jet printing head 30 so that it will be prepared to print a postal indicia on mailpiece 14. Then, the program proceeds to decision block 131 to look at the optical sensor to confirm the presence of mailpiece 14 at the printing position. If, block 131 determines that mailpiece 14 is not present at the printing position, then the program proceeds to block 132 to prevent printing from occurring. Then the program proceeds to block 133 to prevent funds from being accounted. No funds for the printing of a postal indicia will be accounted for or lost. If, block 131 determines that that mailpiece 14 is present at the printing position, then the program proceeds to block 134 to cause ink jet printing head 30 to print a postal indicia on mailpiece 14. The accounting unit of the postal meter (not shown) will account for the value of the postal indicia printed. Then the program goes to block 135 to complete the printing of the postal indicia and confirm that the postal indicia has been printed.

The above specification describes a new and improved loss of funds prevention system for meters that use transfer printing. It is realized that the above description may indicate to those skilled in the art additional ways in which the principles of this invention may be used without departing from the spirit. It is, therefore, intended that this invention be limited only by the scope of the appended claims.

What is claimed is:

1. A postage metering system having an accounting unit for deducting the amount of postage used from the amount of postage purchased and a transfer printing mechanism for printing postage, the improvement comprising:

means for detecting the presence of a mailpiece in which postage is about to be printed thereon; and means for stopping the printing of postage on a mailpiece and deducting the value of the postage about to be printed from the accounting unit when the mailpiece is no longer able to be detected by said detecting means.

2. The system claimed in claim 1, wherein the printing mechanism is a drum having a postal indicia surface.

3. The system claimed in claim 2, further including:

means for removing ink that has been applied to said postal indicia surface.

4. The system claimed in claim 1, wherein the printing mechanism is a drum having means for affixing postage to a mailpiece when the mailpiece contacts said drum.

5. The system claimed in claim 4, further including means for determining the location of said affixing means when said drum is rotating.

6. The system claimed in claim 4, further including means for determining the location of said affixing means relative to a predetermined position of said drum.

7. The system claimed in claim 6, wherein said determining means comprises:

a plurality of equally spaced markings on said drum;

means for detecting said markings; and means coupled to said detecting means for locating the position of said drum relative to detecting marking.

8. The system claimed in claim 6, wherein said determining means comprises:

a variable resistance on said drum;

means for detecting said resistance; and means coupled to said detecting means for locating the position of said drum relative to said variable resistance.

9. The system claimed in claim 1, wherein said locating means is a microprocessor.

10. The system claimed in claim 4, further including:

means for preventing the mailpiece from contacting said drum after it has been determined that postage is not going to be placed on the mailpiece.

11. The system claimed in claim 10, wherein said preventing means comprises:

a gate that physically prevents the mailpiece from coming in contact with said drum; and means for opening and closing said gate.

12. The system claimed in claim 11, further including:

means for pulling said drum away from the mailpiece; and means for continuing the rotation of said drum.

13. The system claimed in claim 10, wherein said preventing means comprises:

means for rotating said drum in the opposite direction that it has been rotating.

14. A postage metering system having an accounting unit for deducting the amount of postage used from the amount of postage purchased and an ink jet printer for printing postage, the improvement comprising:

means for detecting the presence of a mailpiece in which postage is about to be printed thereon; and means for stopping the printing of postage on a mailpiece and deducting the value of the postage about to be printed from the accounting unit when the mailpiece is no longer able to be detected by said detecting means.

* * * * *